US007903077B2

(12) United States Patent
Hiroki

(10) Patent No.: US 7,903,077 B2
(45) **Date of Patent: *Mar. 8, 2011**

(54) IMAGE DISPLAY DEVICE

(75) Inventor: Masaaki Hiroki, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 793 days.

This patent is subject to a terminal disclaimer.

(21) Appl. No.: 11/905,441

(22) Filed: Oct. 1, 2007

(65) Prior Publication Data

US 2008/0036724 A1 Feb. 14, 2008

Related U.S. Application Data

(63) Continuation of application No. 09/294,341, filed on Apr. 20, 1999, now Pat. No. 7,280,093.

(30) Foreign Application Priority Data

Apr. 23, 1998 (JP) ..... 10-129487

(51) Int. Cl.
*G09G 3/36* (2006.01)

(52) U.S. Cl. ..... 345/100; 345/98; 345/99

(58) Field of Classification Search ..... 345/87–100, 345/204, 205, 209, 213, 214
See application file for complete search history.

(56) References Cited

U.S. PATENT DOCUMENTS

| | | | |
|---|---|---|---|
| 3,740,660 | A | 6/1973 | Davies, Jr. |
| 4,472,645 | A | 9/1984 | White |
| 4,645,947 | A | 2/1987 | Prak |
| 5,365,128 | A | 11/1994 | Bazes |
| 5,495,189 | A | 2/1996 | Choi |
| 5,672,991 | A | 9/1997 | Thoma et al. |
| 5,734,378 | A | 3/1998 | Okada et al. |
| 5,801,673 | A | 9/1998 | Shimada et al. |
| 5,811,837 | A | 9/1998 | Misawa et al. |
| 5,883,609 | A | 3/1999 | Asada et al. |
| 5,892,495 | A | 4/1999 | Sakai et al. |
| 6,005,646 | A | 12/1999 | Nakamura et al. |
| 6,011,533 | A | 1/2000 | Aoki |
| 6,011,534 | A | 1/2000 | Tanaka et al. |
| 6,040,816 | A | 3/2000 | Uchino |

(Continued)

FOREIGN PATENT DOCUMENTS

| | | |
|---|---|---|
| JP | 59-161913 | 9/1984 |

(Continued)

*Primary Examiner* — Regina Liang

(74) *Attorney, Agent, or Firm* — Eric J. Robinson; Robinson Intellectual Property Law Office, P.C.

(57) ABSTRACT

An image display device in which a positive clock signal and a negative clock signal of high frequency are made slightly different in a pulse rise time (tr) and a pulse fall time (tf) from each other to reduce the magnitude of noises each having a sharp waveform which noises are generated in a drive circuit (in particular, a shift register circuit) by being superimposed on each other, thereby providing the image display which has the high picture quality and the high definition and which is free from the turbulence of the image. Delay means is provided in a signal producing unit, a control unit, or an input wiring distributed to the associated circuit in order to shift the phases of the positive clock signal and the negative clock signal from each other by the pulse fall time period (tf), thereby reducing the influence exerted on the display.

16 Claims, 8 Drawing Sheets

U.S. PATENT DOCUMENTS

| | | | | |
|---|---|---|---|---|
| 6,064,360 | A | 5/2000 | Sakaedani et al. | |
| 6,077,731 | A | 6/2000 | Yamazaki et al. | |
| 6,144,354 | A | 11/2000 | Koyama et al. | |
| 6,229,513 | B1 | 5/2001 | Nakano et al. | |
| 6,288,699 | B1 | 9/2001 | Kubota et al. | |
| 6,320,566 | B1 | 11/2001 | Go | |
| 6,320,572 | B1 | 11/2001 | Takabayashi et al. | |
| 6,628,253 | B1 | 9/2003 | Hiroki | |
| 7,280,093 | B1 * | 10/2007 | Hiroki | 345/100 |

FOREIGN PATENT DOCUMENTS

| | | |
|---|---|---|
| JP | 59-220793 | 12/1984 |
| JP | 01-115334 | 8/1989 |
| JP | 04-083483 | 3/1992 |
| JP | 04-253209 | 9/1992 |
| JP | 08-008701 | 1/1996 |
| JP | 09-312260 | 12/1997 |
| JP | 11-288339 | 10/1999 |

* cited by examiner

IMAGE DISPLAY DEVICE

BACKGROUND OF THE INVENTION

1. Field of the Invention

The present invention relates in general to an active matrix type display device which employs a display material such as liquid crystal and which self-contains a drive circuit, and more particularly to the technology of relaxing the bad influence which is exerted on the display by the noises generated in the drive circuit or the like to control the unnecessary radiated level within the various EMC (Electromagnetic Compatibility) regulations.

2. Description of the Related Art

In recent years, the technology of forming thin film transistors (hereinafter, referred to as "TFTs" for short, when applicable) on an inexpensive glass substrate has made rapid development. This reason is that the demand for active matrix type liquid crystal display devices has been increased.

The active matrix type liquid crystal display device is such that the TFTs are arranged so as to individually correspond in position to several millions of pixels which are arranged in matrix (hereinafter, referred to as "pixel TFTs" for short, when applicable), and the electric charges which are charged or discharged in or from each pair of pixel electrodes are controlled on the basis of the switching element function of the associated TFT.

In addition, the TFTs for driving the pixel TFTs (for convenience sake, referred to as "the circuit TFTs" for short, when applicable) are incorporated in the peripheral drive circuit, and a pixel portion for display having the pixel TFTs arranged thereon, and a drive circuit portion having the circuit TFTs arranged thereon are formed on the same substrate in order to promote the high integration.

In addition, the display device is desired to have the high display characteristics of further promoting the multi-gradation, the high resolution and the like.

In this connection, the noise which has become conventionally a problem is one of the factors which exert the bad influence on the characteristics to dominate the display characteristics and the electromagnetic radiation.

In order to solve the above-mentioned problem, heretofore, the measures have been adopted in which the circuit configuration for suppressing any of noises is designed.

In order to obtain the display having the high picture quality and the high definition, the required number of display pixels of the display has been increased year by year. For example, in the NTSC Standards, the number of pixels of about 400 thousand is required, and in the HDTV Standards, the number of pixels of about 2 million is required. In such a panel having a large number of pixels, the drive frequency for the video signal will be necessarily very high. Therefore, in order to drive such a panel, the clock signal which has a very rapid dot clock and which has the frequency (in the range of several tens Hz to several tens MHZ) several times as high as that of the video signal is inputted to the drive circuit. For example, the digital video signal (or the analog video signal) which has the frequency band of several tens to several MHZ and several kinds of clock signals which have the frequencies of several MHZ, several tens kHz and several tens Hz in correspondence to each of the circuits included in the drive circuit are inputted to a sampling circuit included in the drive circuit, thereby driving the liquid crystal panel.

In addition, in ideal, the signal rise time period (tr) and the signal fall time period (tf) are both zero or identical to each other (tr=tf). However, in actual, tr and tf are finely different from each other due to the various causes.

As described above, the noises which are generated by inputting at least one pair of signals in which the signal rise time period (tr) and the signal fall time period (tf) are finely different from each other to the drive circuit exert the bad influence on the display characteristics and the electromagnetic radiation, and hence the problem as will hereinbelow be described arises particularly in the case where the signal having the high frequency band is employed.

More specifically, in the drive circuit of the integrated liquid crystal display device which is formed on the same substrate as that of the pixel TFTs, a first clock signal, a second clock signal and a start pulse are all inputted to a shift register circuit and also a shift pulse is fed to the sampling circuit by a buffer circuit. In this connection, the first clock signal and the second clock signal have mutually the reversed phase relation established therebetween, and also each of the circuits is configured in such a way as not to produce the phase difference.

The signal rise time period (tr) and the signal fall time period (tf) of the actual signal are slightly different from each other. Therefore, when inputting the first clock signal and the second clock signal of high frequency which have no phase difference therebetween to the shift register circuit, those clock signals are not cancelled out each other so that the small noises are superimposed on each other to generate the noises each of which has the large amplitude and each of which has the sharp waveform as shown in FIG. 5. Those noises exert the bad influence on the video signal when displaying the image on the screen so that the level of the electromagnetic radiation is varied and hence it is difficult to control the level of the electromagnetic radiation within the EMC Standards. In addition, there is the possibility that the sharp noises each having the large amplitude exert the bad influence on other circuits as well.

Such phenomena occur in the drive circuit (such as a latch circuit, a memory circuit, or a counter circuit) to which the first clock signal and the second clock signal are inputted as well as the above-mentioned shift register circuit. In addition, this is not applied to the clock signal alone. That is, such phenomena occur in a semiconductor integrated circuit to which one pair of signals (which have the reversed phase relation established therebetween) are inputted in which the signal rise time period (tr) and the signal fall time period (tf) are finely different from each other.

As described above, there arises the problem that the noises each having a sharp waveform which have been generated in the shift register circuit or the like are superimposed on the video signal so that the voltage applied to pixel electrodes is varied to change the display.

As the means for solving that problem, heretofore, there has been adopted the configuration in which the circuit for making, with respect to one pair of signals, one signal aligned with the other signal to cancel out the noises is provided every circuit, or the configuration in which the ideal signal waveform is formed in which the signal rise time period (tr) and the signal fall time period (tf) become identical to each other.

However, the circuit configuration becomes complicated in which on the basis of the above-mentioned method, the ideal clock waveforms are formed, and the phase difference between one pair of signals is made just zero, and hence it is difficult to design the circuit. In particular, with respect to one pair of signals of high frequency, it is difficult to make one signal aligned with the other signal, and also it is very difficult to make one signal aligned with the other signal.

SUMMARY OF THE INVENTION

In the light of the foregoing, the present invention was made in order to solve the above-mentioned problems inherent in the prior art, and it is therefore an object of the present invention to provide a display device which is capable of reducing the influence which is exerted on the image display by the noises generated in the drive circuit (in particular, in the shift register circuit).

The configuration of the present invention disclosed in the present specification is an image display device comprising at least:

- a liquid crystal panel having a switching element every pixel electrode;
- a scanning line driving circuit for driving scanning lines of on said liquid crystal panel;
- a signal line driving circuit for driving signal lines of on said liquid crystal panel;
- a control circuit for controlling the drive of said liquid crystal panel;
- a video signal processing circuit; and
- a producing circuit for producing a phase difference in a second signal with respect to a phase of a first signal inputted to said signal line driving circuit or to said scanning line driving circuit.

In the above-mentioned configuration, an image display device is characterized in that the first signal is a signal having the reversed phase relation with the second signal.

Further, in the above-mentioned configuration, an image display device is characterized in that the first signal and the second signal are both clock signals.

Further, in the above-mentioned configuration, an image display device is characterized in that the first signal is different in a signal rise time period (tr) and a signal fall time period (tf) from the second signal.

In the above-mentioned configuration, an image display device is characterized in that the producing signal rise time period (tr) or the signal fall time period (tf) is equal to or shorter than a half of a signal holding time period (tc).

In the above-mentioned configuration, an image display device is characterized in that the circuit for producing the phase difference in the second signal produces, with respect to the phase of the first signal, the phase difference corresponding to at least the signal rise time period (tr) of the first signal or the signal fall time period (tf) of the first signal in the second signal.

In the above-mentioned configuration, the image display device is projection type display means including a transmission type liquid crystal panel and a light source for projection.

DETAILED DESCRIPTION OF THE PREFERRED EMBODIMENTS

Figure 3:
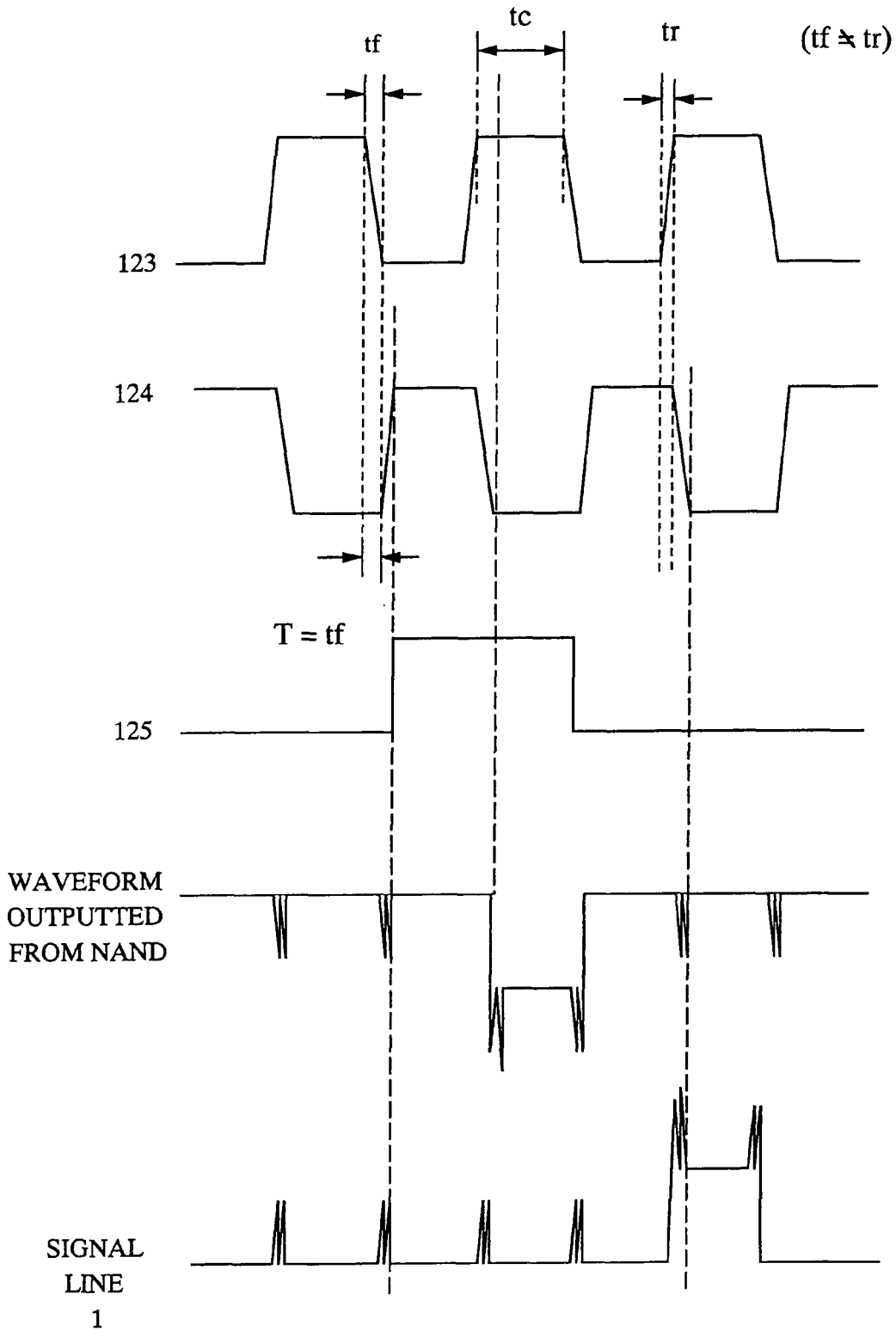
FIG. 3 is a timing chart useful in explaining the operation of the source driver circuit of Embodiment 1.

First of all, the basic principles of the present invention will hereinafter be described. FIG. 3 is a timing chart showing schematically a first clock signal (CLD) 123, a second clock signal (CLD) 124 in which a phase difference with respect to the first clock signal 123 is formed by delay means 100, a start pulse 125, a signal which is outputted from a NAND circuit to which an output signal from a shift register circuit, and a video signal which is applied onto a signal line (1). In this connection, for the sake of simplicity, a source driver circuit 105 will hereinbelow be described with reference to FIG. 3.

The present invention is characterized in that a small phase difference (i.e., a time difference) T is provided between a first clock signal (CL) 117 and a second clock signal (CL) 118 which are produced in a signal producing unit 107, and inputted to the drive circuit.

In order to provide the above-mentioned small phase difference (the time difference) T, a device is configured in such a way as to incorporate the delay means 100 in a control circuit 108. But, the circuit in which the delay means 100 is incorporated is not particularly limited to the control circuit 108, and hence it is to be understood that for example, the delay means 100 may be provided either in an output wiring distributed from a signal producing unit or in an input wiring distributed to a shift register circuit provided in a drive circuit. In this connection, that delay means 100 is an element or a circuit which is mainly constituted by a resistor, a capacitor, a TFT and the like.

While the phase difference (the time difference) T which is provided between the first clock signal (CLD) 123 and the second clock signal (CLD) 124 may have a wide range within the range in which the circuit is normally driven, that range is made at least equal to or longer than either the pulse rise time period (tr) or the pulse fall time period (tf) and equal to or shorter than a half of a pulse holding time period tc (the time period ranging from one output pulse to a next output pulse). That is, the range of the phase difference T is in the range of 1 to 90 degrees. The phase difference T does not become a problem in any way if it is so small as not to cause any inconvenience in the operation of the drive circuit (e.g., the shift register circuit).

In other words, the present invention is characterized in that with respect to one pair of signals which have mutually the reversed phase relation established therebetween (e.g., a first signal and a second signal), the change points (the pulse rise time point and the pulse fall time point) of one signal are not made match those of the other signal, and the one pair of signals are inputted to the drive circuit (e.g., the shift register circuit) at the timing in which one signal is made lag or lead in the phase with respect to the other signal by equal to or longer than a time period corresponding to the pulse rise time period tr or the pulse fall time period tf.

In such a configuration, the waveforms of the signals which are outputted from the drive circuit are characterized in that as shown in FIG. 3, a plurality of noises each having a peak with small amplitude are generated therein. But, the noises thus generated each of which have small amplitude are suitably adjusted within the range in which they do not exert substantially the influence on the display and the drive circuit. In such a way, it is possible to prevent the generation of the noises having peaks each of which has the large amplitude and which were not perfectly cancelled out to be generated in the conventional manner.

Since the present invention has the circuit configuration in which the phase shifted relation is established ($tf<T<\frac{1}{2}tc$, and $tr<T<\frac{1}{2}tc$), the influence of the noises can be reduced with an easy circuit configuration as compared with the circuit configuration having the phase relation in which with respect to one pair of signals, one signal is made with the other signal (the phase difference T=0).

Incidentally, in the present specification, the first clock signal is the clock signal which is generally used and which is inverted in polarity with respect to the second clock signal. While in the present specification, the description will be given using both of the first clock signal and the second clock signal, the present invention is not particularly limited thereto.

In addition, while in the present specification, the description is mainly given using the shift register circuit provided in the source driver circuit, the present invention is not particularly limited thereto, and hence the description may be suitably applied to a latch circuit, a memory circuit, a counter circuit or the like for example.

While the preferred embodiments of the present invention will hereinafter be described in detail with reference to the accompanying drawings, it is to be understood that the present invention is not limited to the preferred embodiments.

Embodiment 1

Figure 1:
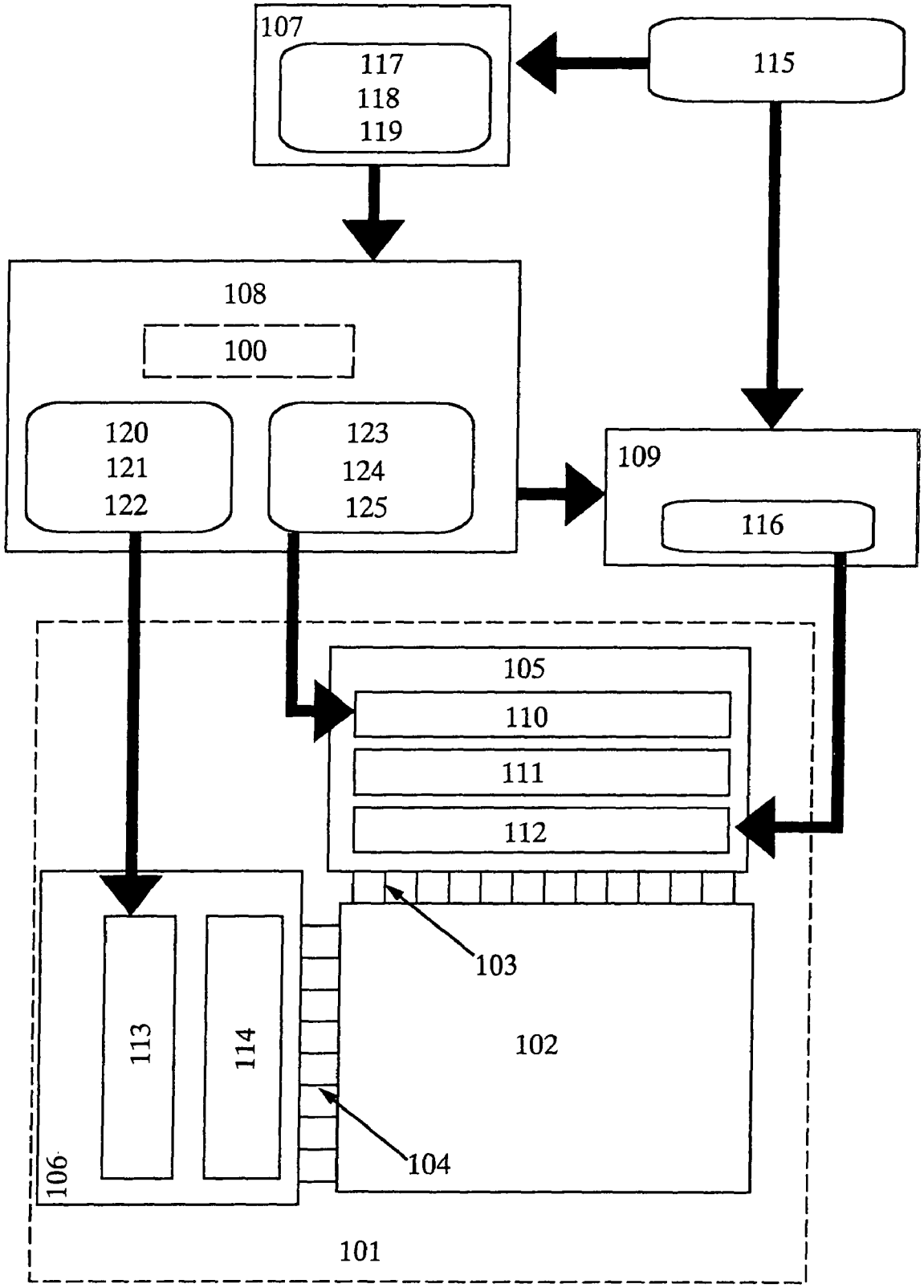
FIG. 1 is a schematic block diagram showing a configuration of an overall image display device of Embodiment 1.

FIG. 1 is a schematic block diagram showing a configuration of an embodiment 1 of a liquid crystal display device according to the present invention. The liquid crystal display device shown in FIG. 1 is mainly constituted by a liquid crystal panel 101, a signal producing unit 107, a video signal processing circuit 109, and a control circuit 108.

In this connection, the signal producing unit 107, the video signal processing circuit 109, the control circuit 108 and the like are, for example, mounted on another printed substrate which is connected to the liquid crystal panel 101 through cables, a flexible wiring board and the like. In addition, it is needless to say that it is preferable that a part of or all of the signal producing unit 107, the video signal processing circuit 109, the control circuit 108 and the like is or are provided on the same substrate as that of the liquid crystal panel 101, since the integration can be realized.

The liquid crystal panel 101 is mainly constituted by a pixel region 102 including a plurality of scanning lines 104 which are distributed horizontally and in parallel with each other, a plurality of signal lines 103 which are distributed in a vertical direction intersecting perpendicularly the plurality of scanning lines 104, TFTs (the thin film transistors) which are arranged in the vicinities of the intersection points between the scanning lines 104 and the signal lines 103, and pixel electrodes which are connected to the TFTs, respectively.

Each of the TFTs is electrically employed as a switch, and also is preferably formed using a silicon film or the like having crystallinity as a semiconductor material. While in the present embodiment, the silicon film having crystallinity is formed by utilizing the crystallization method (refer to Japanese Patent Application Serial No. Hei 8-335152) wherein a silica substrate is employed and nickel is employed as a catalytic element, the present invention is not limited thereto as long as the semiconductor material has crystallinity and the good mobility.

One ends of the scanning lines 104 are respectively connected to gate electrodes of the TFTs and the other ends thereof are respectively connected to a gate driver circuit 106. In addition, one ends of the signal lines 103 are respectively connected to source electrodes of the TFTs and the other ends thereof are respectively connected to a source driver circuit 105.

In this connection, while in FIG. 1, only the several signal lines 103 are illustrated for the sake of simplicity, in an actual case, the number of signal lines 103 is the same as the number of transverse pixel electrodes of the liquid crystal panel. Similarly, the number of scanning lines 104 is the same as the number of lengthwise pixel electrodes of the liquid crystal panel.

In addition, in the liquid crystal panel 101, liquid crystal capacitors are constructed of the pixel electrodes connected to the TFTs, counter electrodes formed on the other substrate, and liquid crystal. Then, the counter electrodes are connected to all of the liquid crystal capacitors and hence have the common electric potential.

The control circuit 108 is the circuit for supplying the necessary pulses (e.g., the start pulses, the clock pulses, the synchronous signal, the signal having the inverted polarity, and the like) to the gate driver circuit 106, the source driver circuit 105, the video signal processing circuit 109 and the like on the basis of a VIDEO signal 115.

In the present embodiment, the VIDEO signal 115 from the outside is inputted to the video signal processing circuit 109 and an analog video signal is outputted to a sampling circuit provided in the source driver circuit. While not specifically illustrated, the video signal processing circuit 109 is mainly constituted by an analog/digital (A/D) conversion circuit, a correction circuit, a digital/analog (D/A) conversion circuit, an reversal processing circuit, and the like.

The source driver circuit 105 consists of a horizontal shift register circuit 110, an output buffer 111, and a sampling circuit 112.

In addition, the gate driver circuit which is provided in the vertical direction consists of a vertical shift register circuit 113 which is capable of carrying out the control of the scanning direction, an output buffer circuit 114 and the like.

Each of the output buffer circuits 111 and 114 in the present embodiment is the circuit for amplifying or impedance-converting the voltage which is being held to apply the resultant signal to the display portion. In this connection, for those output buffers 111 and 114, there are conceivable various kinds of circuits each of which is typically constituted by an inverter.

Figure 2A:
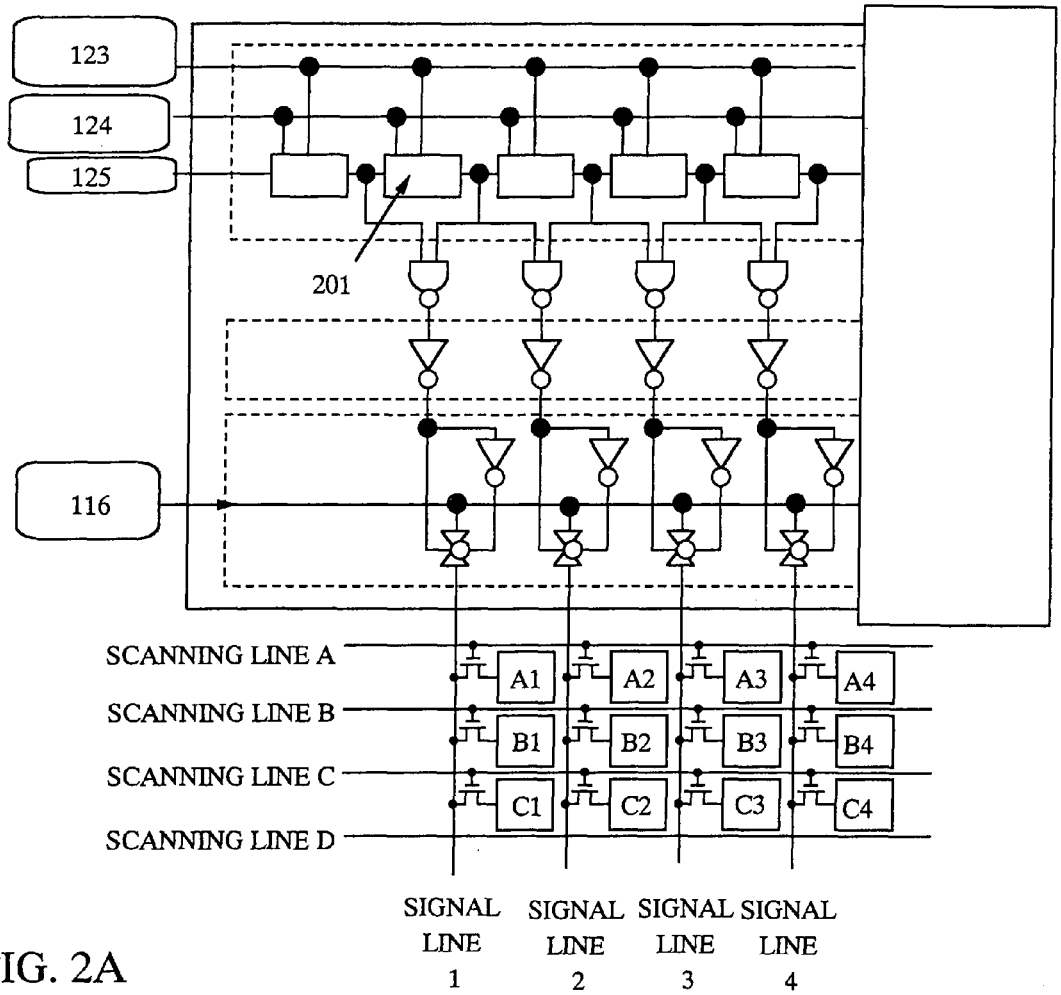
FIG. 2A is a schematic circuit diagram showing a configuration of the periphery of a source driver circuit of Embodiment 1.
Figure 2B:
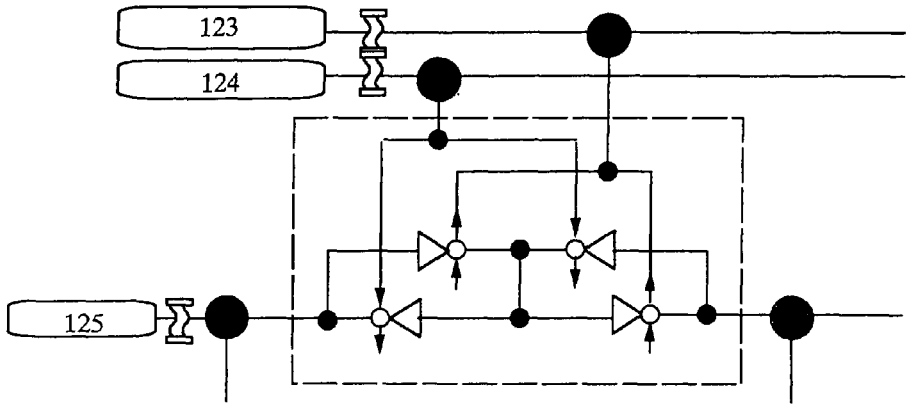
FIG. 2B is an enlarged circuit diagram showing schematically a configuration of a shift register.

FIG. 2A is a schematic circuit diagram showing a configuration of the periphery of the source driver circuit 105 in the embodiment 1. FIG. 2B is an enlarged circuit diagram showing schematically a configuration of a shift register 201. While in FIG. 2A, the configuration is shown in which the one-phase shift registers are employed, in the case where the video signal having a very high frequency is dealt with, it is desirable that a plurality of wiring divisions are made, or instead two-, three-, . . . , or n-phases shift registers are employed to realize the promotion of the low frequency.

For the source driver circuit shown in FIG. 2A, there may be conceivable various kinds of circuits each of which is typically constituted by a shift register, a level shifter, a switch, an inverter, an output buffer circuit and the like. Then, the present invention is not particularly limited to the configuration of the present embodiment as long as each of those circuits is the circuit for sampling the video signal to supply the resultant signal to the display portion.

Incidentally, while in FIG. 1, and FIGS. 2A and 2B, only several signal lines are illustrated for the sake of simplicity, in an actual case, the number of signal lines is the same as the number of transverse pixel electrodes of the liquid crystal panel. Likewise, the number of scanning lines is the same as the number of lengthwise pixel electrodes of the liquid crystal panel.

Now, a VD (a Video Data) 116 as a signal from the video signal processing circuit 109, a start pulse signal SPD 125 from the control circuit 108, the first clock signal CLD 123, the second clock signal CLD 124 the phase of which has been shifted with respect to the first clock signal CLD 123 through the delay means 100, a horizontal synchronous signal and the like are all inputted to the source driver circuit 105. Also, the timing chart in this source driver circuit 105 is shown in FIG. 3.

In the present embodiment, the first clock signal CL 117 and the second clock signal CL 118 which have been produced in the signal producing unit 107 and which have substantially no phase difference are inputted to the control circuit 108, and then the second clock signal CLD 124 which has the phase difference (T=tf) with respect to the first clock signal CLD 123 as shown in FIG. 3 is produced by the delay means 100 which is provided in the control circuit 108 to input the first clock signal CLD 123 and the second clock signal CLD 124 to the source driver circuit 105. The delay means is not limited thereto as long as it is the circuit for producing the phase difference, and hence in the present embodiment, the simple delay circuit which is configured by using a capacitor and a resistor is employed as the delay means 100. In this connection, the position where the delay means of the present embodiment is provided is not particularly limited. That is, there may be adopted the configuration of providing the delay means in the input wiring of the associated circuit, e.g., the configuration of providing a signal delay circuit or the like in the input wiring of the shift register circuit in order to shift the phase.

But, the upper limit of the time period when the phase is shifted is half the voltage holding time period (tc) of the clock signal. If this upper limit is exceeded, then the drive circuit can not be normally driven. That is, when one cycle of the clock signal is assumed to be 360 degrees, the range of the phase difference T is in the range of 1 to 90 degrees.

In such a way, when the phase of the second clock signal CL 118 is shifted from the phase of the first clock signal CL 117 through the delay means 100 by the pulse fall time period (tf) or the pulse rise time period (tr), the magnitude of the noise generated on the basis of the two clock signals which are different in tr or tf from each other can be reduced.

Figure 5:
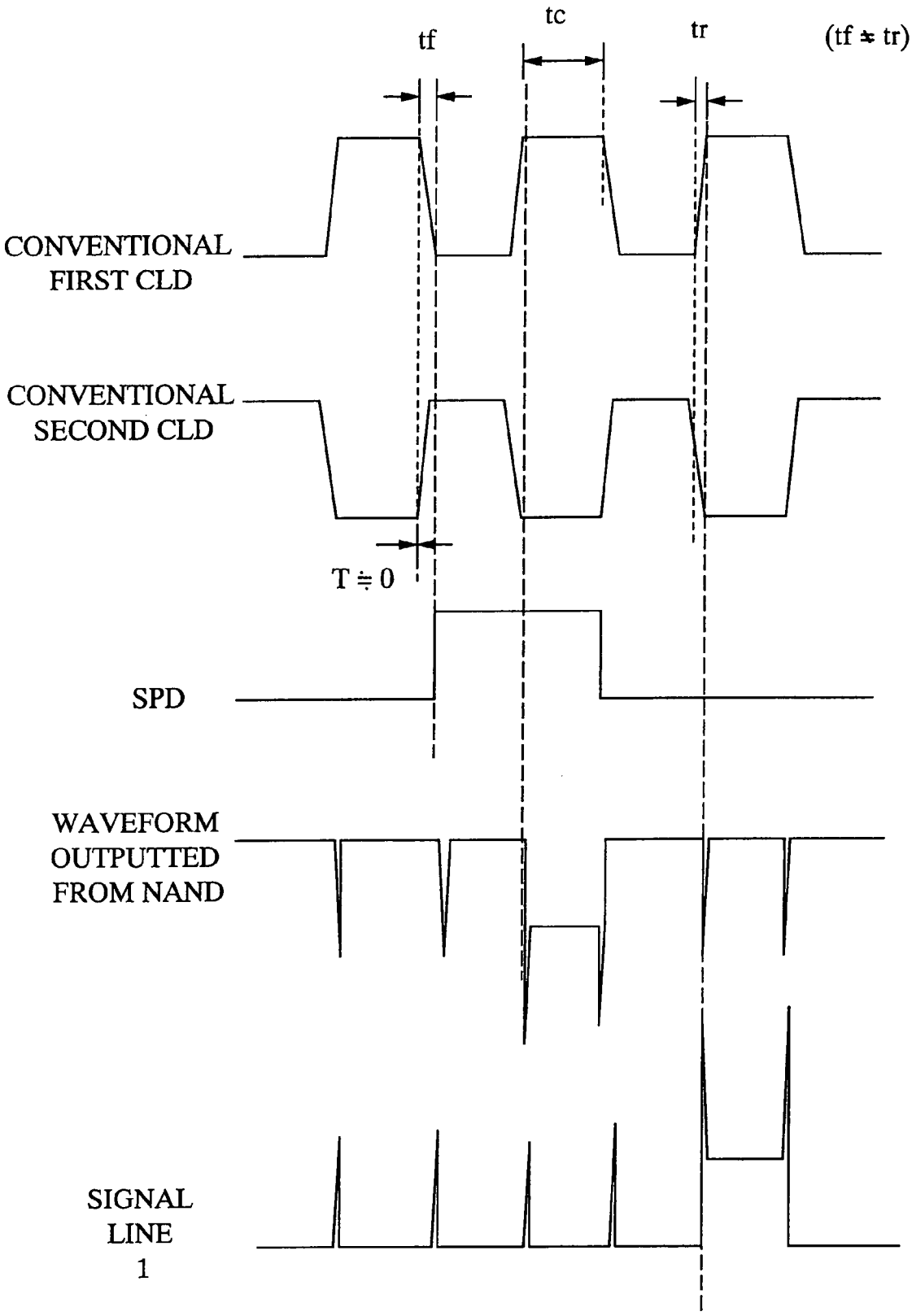
FIG. 5 PRIOR ART
FIG. 5 is a timing chart useful in explaining the operation of a conventional display device.

The feature of the present invention is that the phases of a plurality pairs of inputted signals are shifted from each other by a predetermined amount, and also a plurality of noises each having a peak with small amplitude are intentionally generated. In other words, the feature of the present invention is not that the phase of one signal is made aligned with the other signal to eliminate any noise as in the prior art method, but that the noises are prevented from being superimposed on each other in order to prevent any noise having a sharp peak with very large amplitude from being generated. In the present embodiment, as shown in FIG. 3, the noises having a plurality of peaks are formed. Each of the plurality of peaks is smaller in amplitude than each of the conventional peaks as shown in FIG. 5, and hence does not exert influence on the display at all.

That is, the present embodiment adopts the simple configuration (the provision of the simple delay circuit) as compared with the conventional method wherein with respect to one pair of pulse signals, one pulse signal is aligned with the other pulse signal as much as possible, whereby the phase of one pulse signal is shifted with respect to the phase of the other pulse signal by only the pulse fall time period (tf) or the pulse rise time period (tr) to prevent the noises from exerting influence on the display, and also the electromagnetic radiation can be controlled within the range to which the EMC regulations are made.

Embodiment 2

While in the embodiment 1, there has been adopted the method wherein a plurality of signals the phases of which are intentionally shifted from each other are inputted to the drive circuit in order to prevent the noises from being superimposed on each other, in the present embodiment, an example of another configuration is adopted.

In the present embodiment, one pair of signals the phases of which are intentionally shifted from each other in a similar manner to that of the embodiment 1 are inputted to the drive circuit. Then, the signals the phases of which are shifted from each other are adjusted in phases in the inside of the drive circuit to cancel out any of the noises to output the signals which are aligned with each other. By adopting such a configuration, the video signal which is free from any of noises can be formed and also the excellent display characteristics can be obtained.

Embodiment 3

Figure 4:
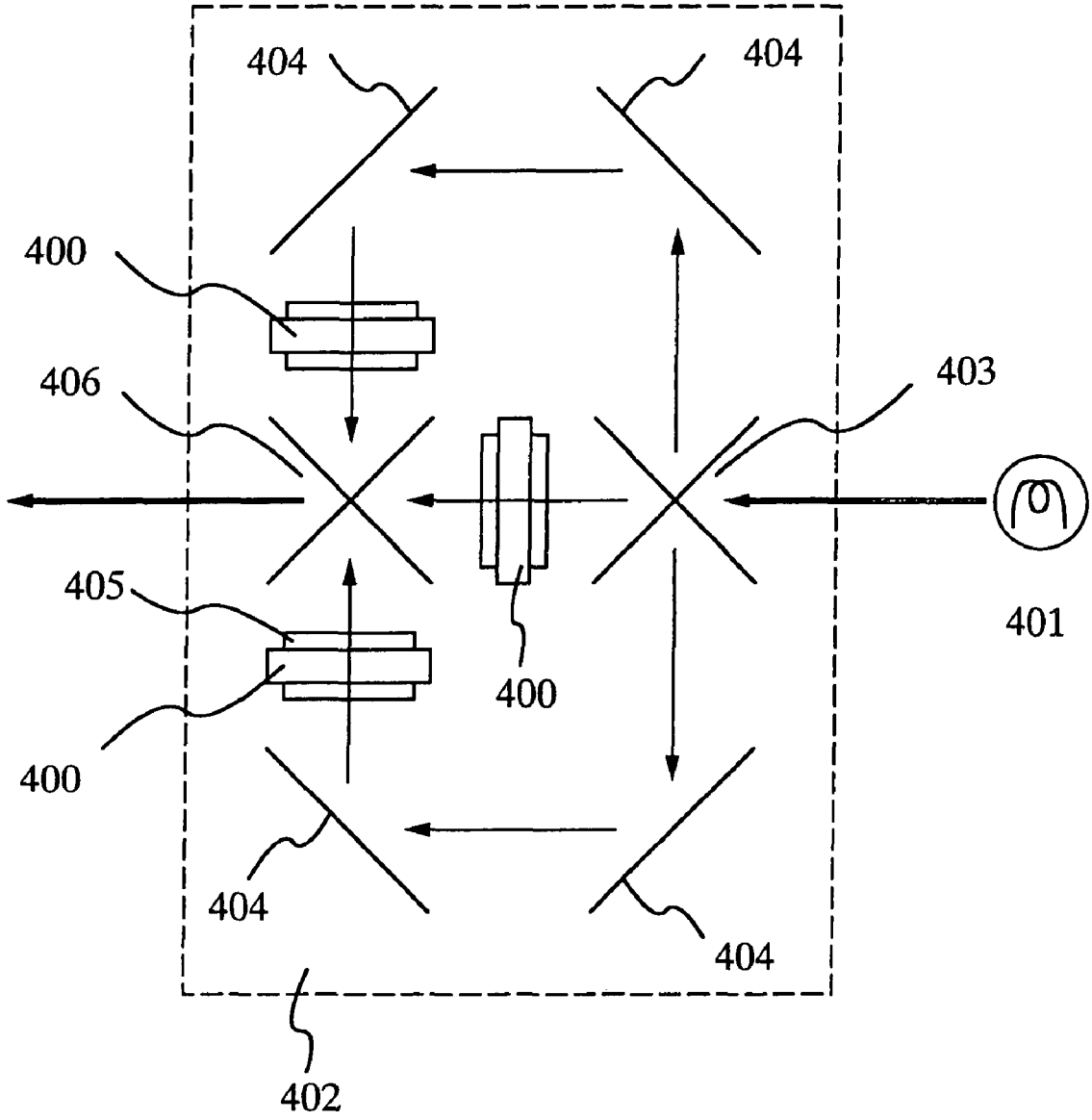
FIG. 4 is a schematic view showing a structure of a projection device of Embodiment 3.

FIG. 4 is a schematic view showing the outline of a projection type image display device (a rear projector) employing a three-plates optical system. In the projector of the present embodiment, the projected light which has been projected from a light source 401 is separated into the primaries R, G and B which are in turn respectively introduced into three-sheets of TFT liquid crystal panels 400 for displaying thereon the images having the respective colors through mirrors 404. Then, the light beams which have been obtained on the basis of the modulation in the respective TFT liquid crystal panels are combined with each other through an optical system 406 to be a video light beam which is in turn applied to the screen so that the color image is projected.

When by employing the liquid crystal panel, the signal processing circuit and the control circuit shown in the above-mentioned embodiment 1, the input image signals are supplied to the respective liquid crystal panels, the images having the respective colors can be produced with high picture quality and high resolution and without color bleeding by the respective liquid crystal panels. In addition thereto, since the liquid crystal γ correction, the camera γ correction, the correction which is suited to the visual sensation of the human being, the correction which is fitted to the demand of an observer, and the like are carried out by the correction circuit, it is possible to obtain the image which is excellent in the γ characteristics.

Therefore, by employing the rear projector of the present embodiment, the clean image the picture quality of which is free from the turbulence can be displayed on the screen.

In this connection, while in the present invention, the active matrix type panel is employed as the liquid crystal panel by way of illustration, it is to be understood that the different kinds of other liquid crystal panels may also be employed.

In addition, the present invention is not applied to only the drive circuit integrated liquid crystal display device, and hence the present invention may also be applied to the so-called separation type display device in which the drive circuit is formed on a substrate different from that of the liquid crystal panel.

Incidentally, the configuration of the shift register circuit, the buffer circuit, the sampling circuit, the memory circuit and the like which have been shown in the above-mentioned embodiments is taken as an example, and hence it is to be understood that it can be suitably modified as long as it has the similar function.

Embodiment 4

The liquid crystal display devices which have been shown in the embodiments 1 and 2 are utilized as the display devices for use in various kinds of electronic apparatuses. In this connection, the electronic apparatus which is cited in the present embodiment is defined as the product to which the active matrix type liquid crystal display device is mounted.

As such electronic apparatus, a video camera, a digital camera, a projector (rear type or front type), a head mount display (a goggle type display), a car navigation system, a personal computer, a portable information terminal (mobile computer, portable telephone, electric book, etc.) and the like are enumerated. Examples of those are shown in FIGS. 6A to 6F, 7A to 7D, and 8A to 8C.

Figure 6A:
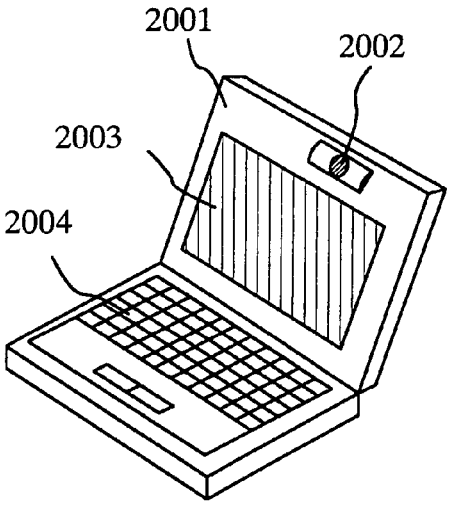
FIGS. 6A to 6F, 7A to 7D, and 8A to 8C are schematic views showing semiconductor devices as products applied of Embodiment 4.

FIG. 6A shows a personal computer which is constituted by a main body 2001, an image input portion 2002, a display device 2003, and a keyboard 2004. The present invention can be applied to the image input portion 2002, the display device 2003, and other signal control circuits.

Figure 6B:
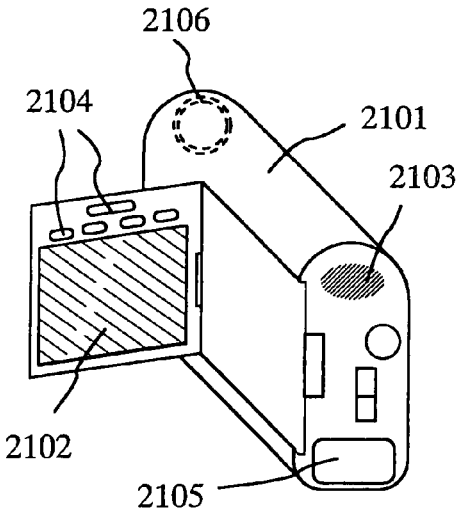

FIG. 6B shows a video camera which is constituted by a main body 2101, a display device 2102, an audio input portion 2103, an operation switch 2104, a battery 2105, and an image receiving portion 2106. The present invention can be applied to the display device 2102, the audio input portion 2103, and other signal control circuits.

Figure 6C:
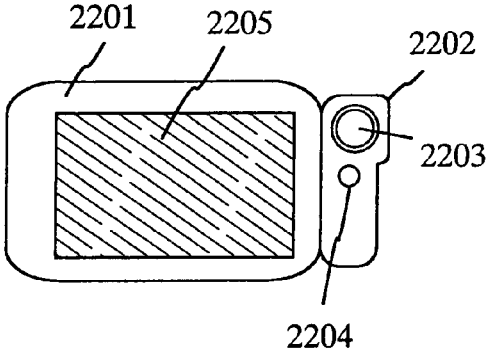

FIG. 6C shows a mobile computer which is constituted by a main body 2201, a camera portion 2202, an image receiving portion 2203, an operation switch 2204, and a display device 2205. The present invention can be applied to the display device 2205 and other signal control circuits.

Figure 6D:
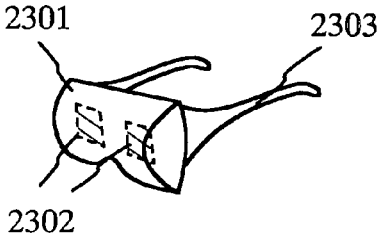

FIG. 6D shows a goggle type display which is constituted by a main body 2301, a display device 2302, and an arm portion 2303. The present invention can be applied to the display device 2302 and other signal control circuits.

Figure 6E:
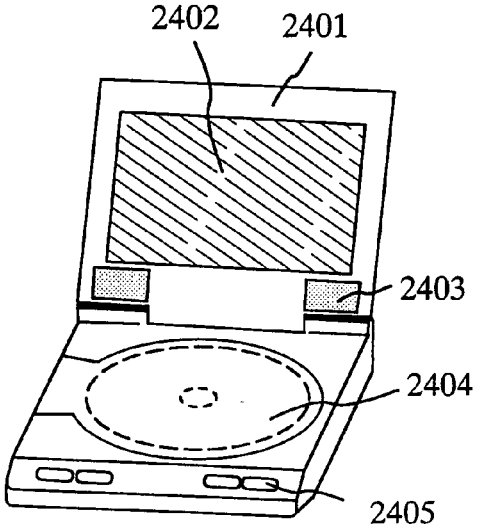

FIG. 6E shows a player apparatus which is equipped with a recording medium for recording a program (hereinafter, called "a recording medium"). The player apparatus is constituted by a main body 2401, a display device 2402, a speaker portion 2403, a recording medium 2404, an operation switch 2405 and an eternal input portion 2406. This apparatus includes a DVD (digital Versatile Disc), a CD and the like as the recording medium for appreciating music and movie, playing a game, and Internet. The present invention can be applied to the display device 2402 and other signal control circuits.

Figure 6F:
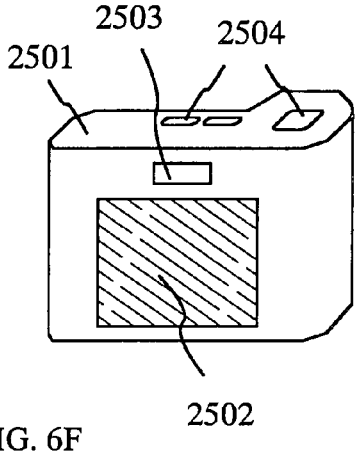

FIG. 6F shows a digital camera which is constituted by a main boy 2501, a display device 2502, an eyepiece portion 2503, an operation switch 2504 and an image receiving portion (not shown). The present invention can be applied to the display device 2502 and other signal control circuits.

Figure 7A:
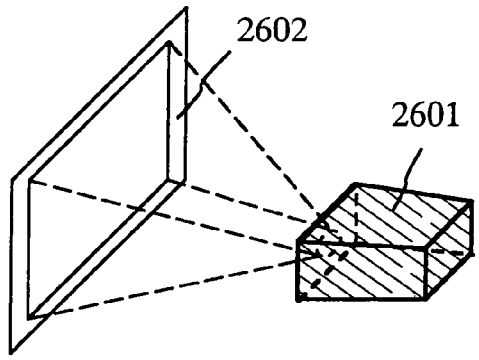

FIG. 7A shows a front type projector which is constituted by a light source optical system and a display device 2601, and a screen 2602. The present invention can be applied to the display device and other signal control circuits.

Figure 7B:
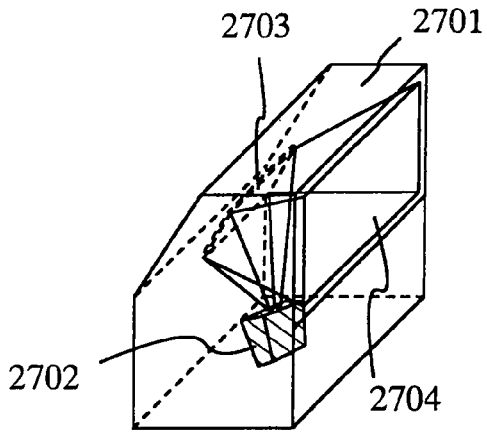

FIG. 7B shows a rear type projector which is constituted by a main body 2701, a light source optical system and a display device 2702, a mirror 2703 and a screen 2704. The present invention can be applied to the display device and other signal control circuits.

Figure 7C:
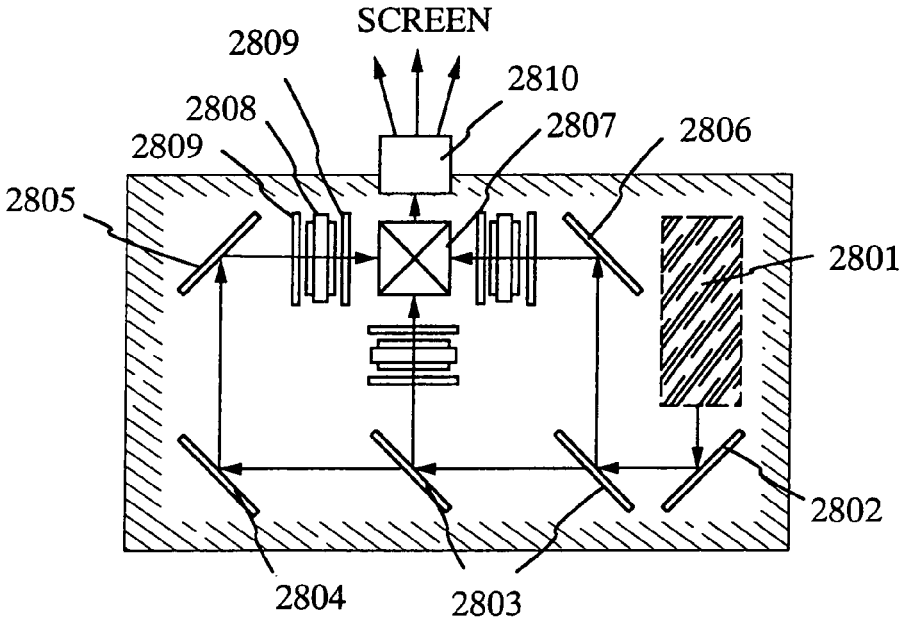

FIG. 7C shows an example structure of a light source optical system and a display device 2601 in FIG. 7A, or 2702 in FIG. 7B. Each of numerals 2601 and 2702 includes a light source optical system 2801, mirrors 2802, 2804-2806, a dichroic mirror 2803, another optical system 2807, a display device 2808, a phase difference plate 2809, and a projection optical system 2810. The projection optical system 2810 is constituted by a plurality of optical lenses equipped with a projection lens. Such a projection system as shown in FIG. 7C is called a three-plate type since this structure includes three plates of display devices. Further, it is proper for a researcher to form, in an optical path indicated by an arrow in FIG. 7C, an optical lens, a film with a polarizing characteristics, a film to control a phase difference, an IR film, etc.

Figure 7D:
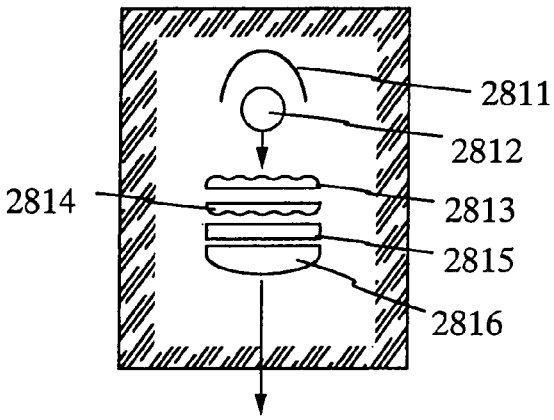

FIG. 7D shown an example structure of a light source optical system 2801 in FIG. 7C. In this embodiment, the light source optical system 2801 includes a reflector 2811, a light source 2812, lens arrays 2813 and 2814, a polarizing conversion element 2815 and a condenser lens 2816. However, the present invention is not specifically limited by this embodiment because it is just an example. For example, in an optical path, an optical lens, a film with a polarizing characteristics, a film to control a phase difference, an IR film, etc. can be properly formed.

Figure 8A:
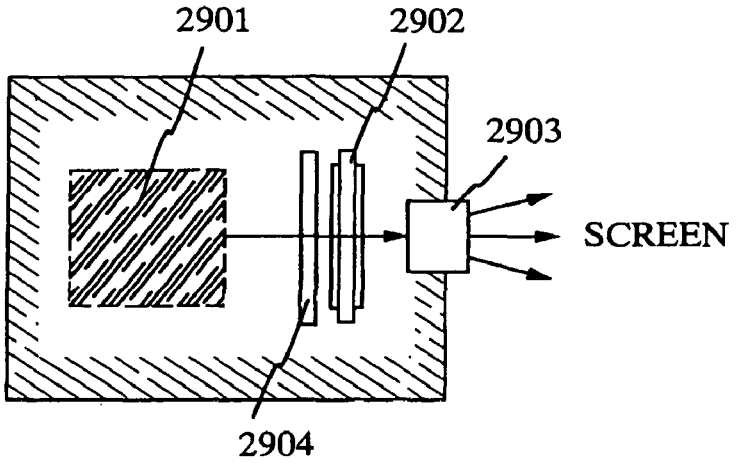

While FIG. 7C shows an example of the three-plate type, FIG. 8A shows an example of single-plate type. A light source optical system 2901, a display device 2902, a projection optical system 2903 are included in a light source optical system and a display device shown in FIG. 8A. It is possible to apply the light source optical system and display device shown in FIG. 8A to the light source optical system and display device 2601 shown in FIG. 7A, or 2702 in FIG. 7B. Further, the light source optical system 2901 can be applied by the light source optical system shown in FIG. 7D. In addition, the display device 2902 is equipped with a color filter (not shown), so that display image is colored.

Figure 8B:
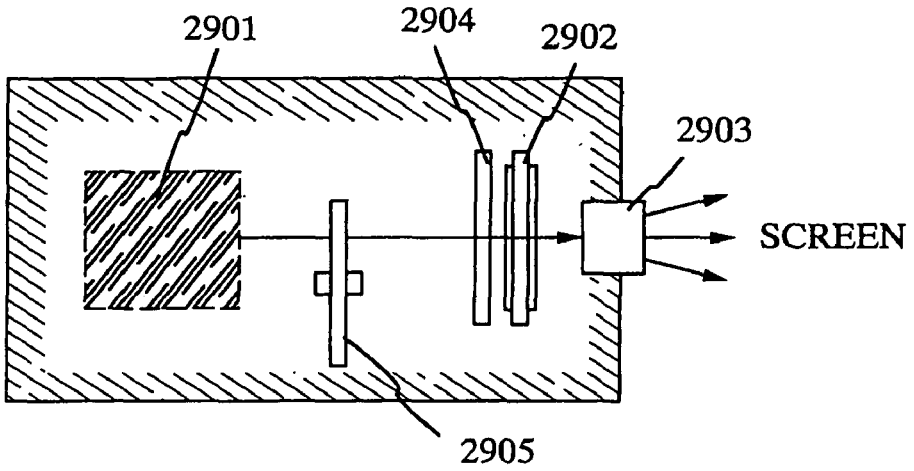

FIG. 8B shows an applied example of a light source optical system and a display device which is applied by FIG. 8A. Instead of forming a color filter, a display image is colored by RGB rotary color filter disc 2905. It is possible to apply the light source optical system and display device shown in FIG. 8B to the light source optical system and display device 2601 shown in FIG. 7A, or 2702 in FIG. 7B.

Figure 8C:
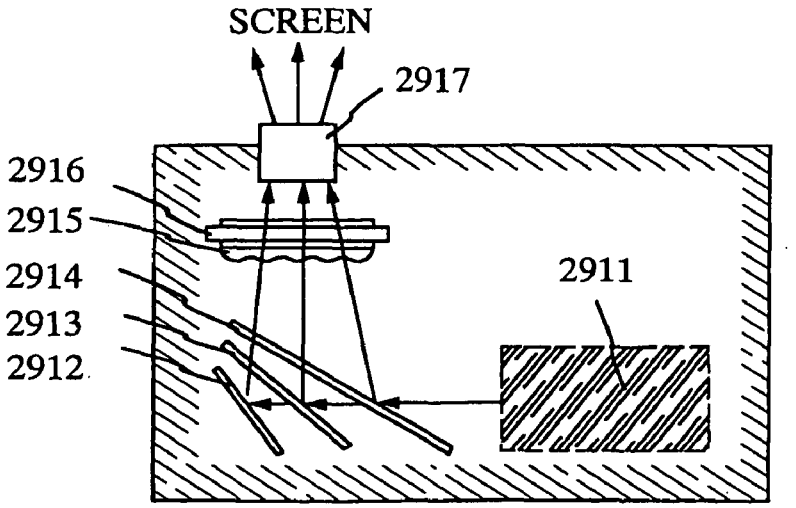

A structure of the light source optical system and display device, as shown in FIG. 8C is called as a color-filterless single-plate type. In this structure, a display device 2916 is equipped with a microlens array 2915, and a display image is colored by a dichroic mirror (Green) 2912, a dichroic mirror (Red) 2913 and a dichroic mirror (Blue). A projection optical system 2917 is constituted by a plurality of lenses including a projection lens. It is possible to apply the light source optical system and display device shown in FIG. 8C to the light source optical system and display device 2601 shown in FIG. 7A, or 2702 in FIG. 7B. Further, as the light source optical system 2911, an optical system having a coupling lens and a collimating lens other than a light source can be applied.

As described above, the scope to which the present invention is applied is very wide, and hence the present invention can be applied to electronic apparatuses in any field. Also, in addition thereto, the present invention can also be applied to an electric bulletin board, a display for publicity and advertisement, and the like.

As set forth hereinabove, according to the present invention, delay means is provided in a predetermined position in order to shift the phases of two signals having the reversed phase relation established therebetween, e.g., the phases of a first clock signal and a second clock signal from each other by a predetermined amount. Then, the magnitude of each of the noises in a drive circuit is reduced to the degree of not exerting influence on the display, and also a circuit configuration is adopted in which the electromagnetic radiation can be readily controlled within the range to which the EMC regulations are made.

Accordingly, since a video signal having a high frequency can be accurately displayed, it is possible to provide a user with the display which has the high picture quality and the high definition.

What is claimed is:

1. A display device comprising:

a display panel comprising a pixel electrode and a switching element connected to the pixel electrode;

a gate driver circuit arranged to drive the display panel;

a source driver circuit comprising a shift register, the source driver circuit being arranged to drive the display panel; and a delay circuit producing a phase difference in a second clock signal with respect to a phase of a first clock signal, wherein the first clock signal and the second clock signal are input to the shift register, wherein a length of the phase difference is at least a signal rise time period of the first clock signal or a signal fall time period of the first clock signal and shorter than a half of a signal holding time period, and wherein the first clock signal has a reversed phase relation with the second clock signal.

2. A display device comprising:

a display panel comprising a pixel electrode and a thin film transistor connected to the pixel electrode;

a gate driver circuit arranged to drive the display panel;

a source driver circuit comprising a shift register, the source driver circuit being arranged to drive the display panel; and a delay circuit producing a phase difference in a second clock signal with respect to a phase of a first clock signal, wherein the first clock signal and the second clock signal are input to the shift register, wherein a length of the phase difference is at least a signal rise time period of the first clock signal or a signal fall time period of the first clock signal and shorter than a half of a signal holding time period, wherein the thin film transistor comprises a semiconductor film having a crystallinity, and wherein the first clock signal has a reversed phase relation with the second clock signal.

3. A display device comprising:

a display panel comprising a pixel electrode and a switching element connected to the pixel electrode;

a gate driver circuit arranged to drive the display panel;

a source driver circuit comprising a latch circuit, the source driver circuit being arranged to drive the display panel; and a delay circuit producing a phase difference in a second clock signal with respect to a phase of a first clock signal, wherein the first clock signal and the second clock signal are input to the latch circuit, wherein a length of the phase difference is at least a signal rise time period of the first clock signal or a signal fall time period of the first clock signal and shorter than a half of a signal holding time period, wherein the first clock signal has a reversed phase relation with the second clock signal.

4. A display device comprising:

a display panel comprising a pixel electrode and a thin film transistor connected to the pixel electrode;

a gate driver circuit;

a source driver circuit comprising a latch circuit, a delay circuit producing a phase difference in a second clock signal with respect to a phase of a first clock signal, wherein the first clock signal and the second clock signal are input to the latch circuit, wherein a length of the phase difference is at least a signal rise time period of the first clock signal or a signal fall time period of the first clock signal and shorter than a half of a signal holding time period, wherein the thin film transistor comprises a semiconductor film having a crystallinity, and wherein the first clock signal has a reversed phase relation with the second clock signal.

5. A display device according to claim 1, wherein the first clock signal has a different rise time period and a different signal fall time period from the second clock signal.

6. A display device according to claim 2, wherein the first clock signal has a different rise time period and a different signal fall time period from the second clock signal.

7. A display device according to claim 3, wherein the first clock signal has a different rise time period and a different signal fall time period from the second clock signal.

8. A display device according to claim 4, wherein the first clock signal has a different rise time period and a different signal fall time period from the second clock signal.

9. A display device according to claim 1, wherein the signal rise time period or the signal fall time period is equal to or shorter than a half of the signal holding time period.

10. A display device according to claim 2, wherein the signal rise time period or the signal fall time period is equal to or shorter than a half of the signal holding time period.

11. A display device according to claim 3, wherein the signal rise time period or the signal fall time period is equal to or shorter than a half of the signal holding time period.

12. A display device according to claim 4, wherein the signal rise time period or the signal fall time period is equal to or shorter than a half of the signal holding time period.

13. A display device according to claim 1, wherein said display device is a liquid crystal display device.

14. A display device according to claim 2, wherein said display device is a liquid crystal display device.

15. A display device according to claim 3, wherein said display device is a liquid crystal display device.

16. A display device according to claim 4, wherein said display device is a liquid crystal display device.

* * * * *